United States Patent [19]

Hyler

[11] 3,984,927

[45] Oct. 12, 1976

[54] AUTOMATIC CONTROL OF ELEVATOR HEIGHT IN SCRAPER WITH MANUAL SETTING AND SELECTION OF ALTERNATE MODES

[75] Inventor: John H. Hyler, Peoria, Ill.

[73] Assignee: Westinghouse Air Brake Company, Pittsburgh, Pa.

[22] Filed: May 19, 1975

[21] Appl. No.: 578,760

Related U.S. Application Data

[63] Continuation-in-part of Ser. No. 508,360, Sept. 23, 1974, Pat. No. 3,900,977, and a continuation-in-part of Ser. No. 510,143, Sept. 30, 1974, Pat. No. 3,303,623.

[52] U.S. Cl. ..... 37/8; 37/124

[51] Int. Cl.[2] ..... B60P 1/36

[58] Field of Search..... 37/8, 124, 126 R, 126 A, 37/129

[56] References Cited

UNITED STATES PATENTS

| | | | |
|---|---|---|---|
| 3,296,716 | 1/1967 | Rezabek et al. | 37/8 |
| 3,466,764 | 9/1969 | Smith | 37/8 |
| 3,484,960 | 12/1969 | Kokaly et al. | 37/8 |
| 3,653,132 | 4/1972 | Campbell et al. | 37/8 |
| 3,818,618 | 6/1974 | Hyler | 37/8 |

*Primary Examiner*—E. H. Eickholt

*Attorney, Agent, or Firm*—Leydig, Voit, Osann, Mayer & Holt, Ltd.

[57] ABSTRACT

An elevating type scraper for earth moving purposes having an open-fronted bowl with rear supporting wheels and with a scraper blade at the front of the bowl. The bowl is pivotally supported on a pair of draft members forming a part of a tractor-supported draft frame. A bowl hoist actuator interposed between the draft frame and the front end of the bowl determines the degree of tilt of the bowl and hence the depth of cut of the blade. An elevator of the endless conveyor type is positioned at the front end of the bowl in sweeping engagement with the undisturbed ground and inclined upwardly and rearwardly so that the soil loosened by the blade is conveyed into the bowl. The elevator is mounted on the bowl for upward and downward swinging movement and is supported in operating position by an elevator-supporting actuator. For engaging the actuator, a bracket at the front of the elevator frame provides a point of connection, and the actuator extends upwardly and rearwardly from the tractor draft frame to such point of connection, so that when fluid is locked in the actuator the elevator is maintained at a desired sweeping height automatically and in spite of changes in degree of tilt of the bowl and depth cut of the blade. Means including a control valve are provided for the elevator supporting actuator for creating a closed loop between the ends of the actuator for establishing a "free float" condition in which the elevator is free to rise and fall upon encountering an obstruction. The valve means further includes a check valve in the loop to establish an alternative "checked float" condition in which the elevator can rise to meet an obstruction but in which the elevator is temporarily held in such operating position until intentionally lowered.

9 Claims, 7 Drawing Figures

Fig. 1.
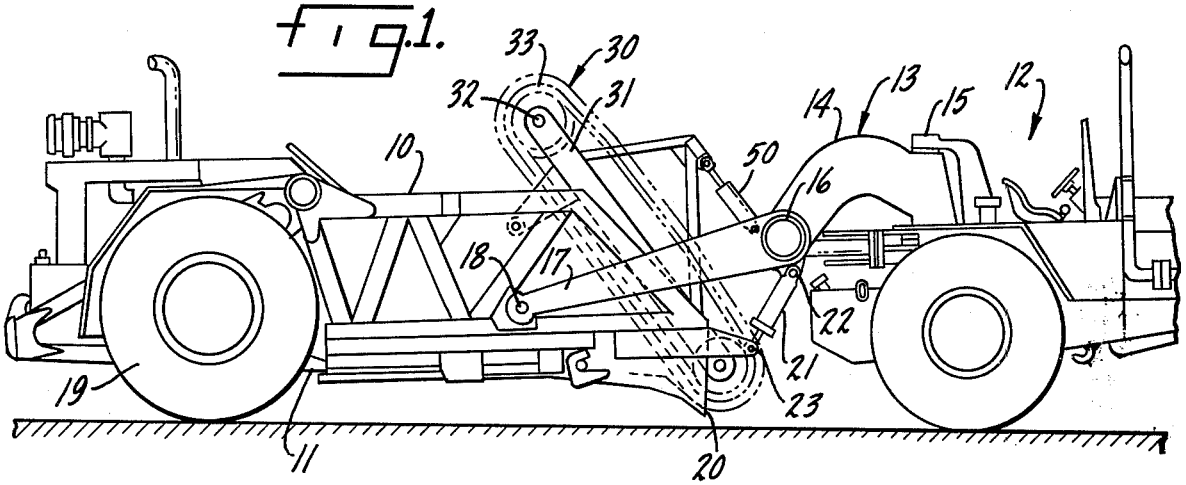
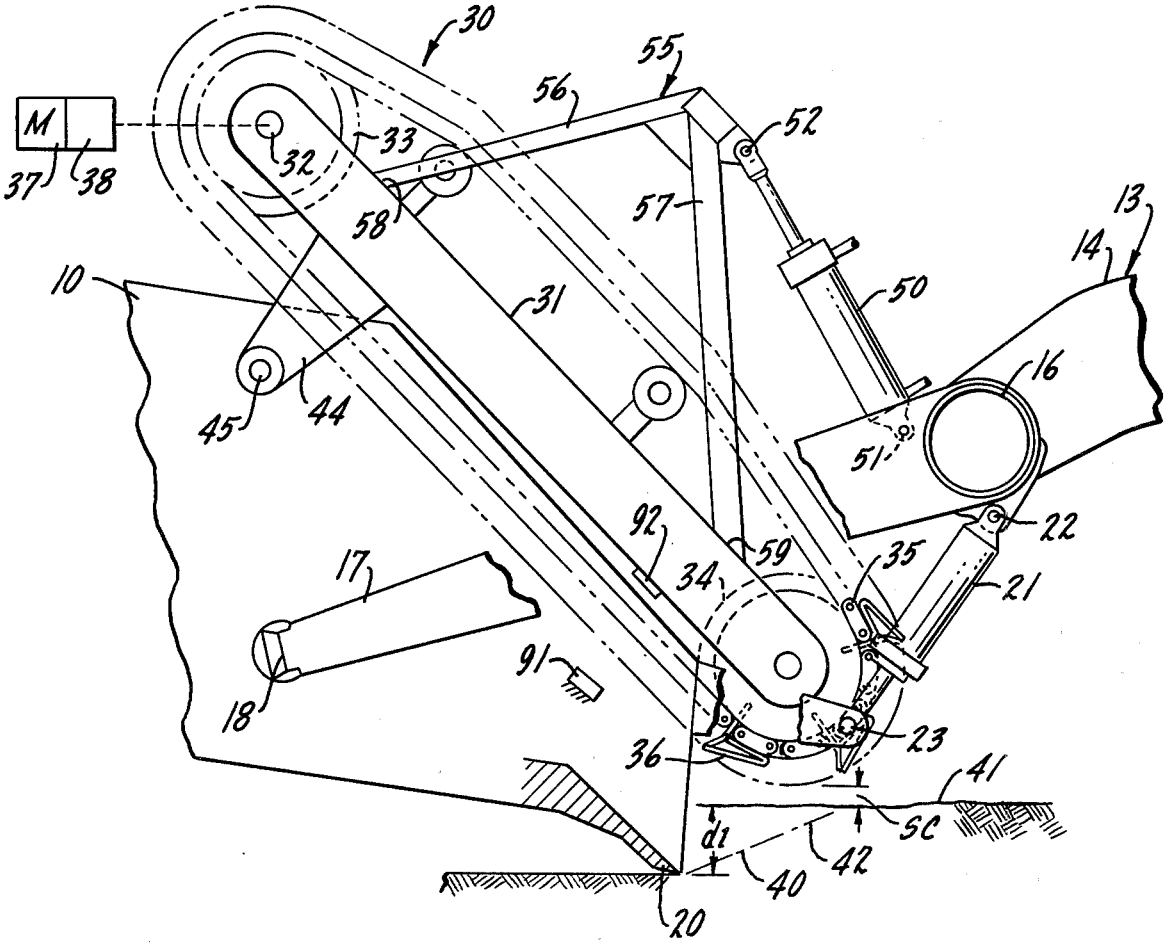
Fig. 2.

17
16
22
21
106
107
10
105
101
23
TRAVEL POSITION
(VALVE PLUNGER
RELEASED)
WORKING ANGLE
(VALVE PLUNGER
DEPRESSED)

AUTOMATIC CONTROL OF ELEVATOR HEIGHT IN SCRAPER WITH MANUAL SETTING AND SELECTION OF ALTERNATE MODES

This is a continuation in part of U. S. application Ser. No. 508,360 filed Sept. 23, 1974 now U.S. Pat. No. 3,900,977 and Ser. No. 510,143 filed Sept. 30, 1974 now U.S. Pat. No. 3,903,623.

BACKGROUND OF THE INVENTION

The invention relates to an earth-moving device in the form of a tractor-driven scraper having a blade for loosening the soil and an elevator for conveying the loosened soil into the scraper bowl and which has improved means for automatically maintaining the elevator in predetermined sweeping relation with respect to the ground regardless of the depth of cut. In conventional elevating type scrapers the normal running position is determined by a pair of stops, one mounted on the elevator frame and the other on the bowl. The stops are adjustable so as to provide the proper relationship between the conveyor and the undisturbed ground ahead of the blade for an assumed average depth of cut. However, the problem is that the depth of cut, which is under the control of the machine operator, can be varied over rather wide limits. In most prior constructions, when the blade is lowered to obtain a deeper cut, the elevator is correspondingly lowered so that the elevator flights, instead of sweeping the surface of the undisturbed ground at a clearance height, strike the surface with some violence. Conversely, when the blade is adjusted to a higher cutting level, the elevator tends to ride too high, thereby reducing the loading efficiency and retention of the soil.

Where the elevator is positioned too low, the shocks to the elevator structure and its driving system, particularly where the ground is hard, may be so severe as to be of destructive effect. As each flight strikes the ground, the elevator, in effect, tries to "climb up" upon the flight, resulting in a high peak loading, loss of power, and vibration which affects not only the elevator but the whole scraper assembly, with annoyance and fatigue to the operator.

This condition has been so consistently encountered in the past that compromises have been incorporated into the design and operation of the elevator such as driving the elevator at reduced speed and the use of additional, more closely spaced flights, all of which have meant a sacrifice in loading efficiency. Moreover, when the elevator rides too high or too low and does not load efficiently, the loosened soil which piles up ahead of the blade must be constantly pushed by the blade requiring greater tractive effort and the use of greater horsepower.

In an effort to overcome these problems, adjustable stops have been provided to accommodate the elevator height to the particular cutting level being employed, but changing of the stops is burdensome and time-consuming and requires temporary shut down of the machine. Consequently, where the operator must change the cutting height frequently, he usually finds it more practical to tolerate the vibration and other effects than to make frequent stop adjustments.

Efforts have been made in the past to maintain the elevator at a predetermined sweeping height, regardless of depth of cut, by coupling the elevator to the tractor draft frame. For example, in Hyler et al prior U.S. Pat. No. 3,807,063 which issued Apr. 30, 1974, the elevator frame is provided with a stop which engages a cooperating upwardly facing stop on the draft frame. This provides approximate maintenance of the sweeping height of the elevator, considering the fact that the draft frame itself sinks slightly upon tilting the bowl to increase the depth of cut and rises slightly for a shallow cut. Moreover, the patented construction does not permit supervisory control of the maintenance height by the operator or capability of switching to alternate modes of operation. To compensate for changes in level of the draft frame resort has been had to special linkages and servo systems and disclosed in my prior application, Ser. No. 508,360 filed Sept. 23, 1974, now U.S. Pat. No. 3,900,977, and my prior application Ser. No. 510,143 filed Sept. 30, 1974, now U.S. Pat. No. 3,303,623.

SUMMARY OF THE INVENTION

It is, accordingly, an object of the invention to provide an improved and simplified automatic elevator height control for a scraper in which the elevator is automatically maintained at a predetermined sweeping height with respect to the undisturbed ground regardless of variations in the tilt of the bowl and depth of cut of the blade, taking into account the rise and fall of the draft frame, but without use of special compensating linkages or servo systems. It is a more specific object of the invention to provide automatic maintenance of elevator height, regardless of depth of cut, by providing a bracket on the upper portion of the elevator frame and an actuator which extends upwardly and rearwardly from the draft frame to a point of connection on the bracket. By reason of the upward and rearward angling, use is made of the slight downward scissoring action which occurs between the draft frame and the bowl when the bowl is rocked downwardly to take a deeper cut, the scissoring action to raise the elevator thereby to compensate for the downward sink of the draft frame, and conversely, to compensate for the rise of the frame when taking a shallow cut.

It is another object of the invention to provide control means for the elevator supporting actuator which permits remote control, by the operator, of the maintained elevator height above undisturbed ground, between a condition of safe "minimum" height at one extreme and a "rock clearance" limit at the other. It is a related object to provide control means with capability of intentional raising of the elevator to clear and accommodate boulders, windrows and other obstructions and which enables the elevator to be operated in alternative "free float" and "checked float" modes.

When operated in the "free float" mode, the elevator is free to climb upwardly upon an obstruction such as a windrow, and to lower itself when the obstruction is safely past. In the "checked float" mode the elevator is free to protect itself by climbing upon an obstruction, but the elevator automatically maintains itself at the higher level until the level is reduced by intervention of the operator who restores the elevator to a normal running level. In both the "float" modes of operation movement is hydraulically cushioned to avoid bouncing of the elevator and the possibility of hammering at the limit stop surface.

It is a general object to provide an elevator height control in which the elevator is automatically maintained at sweeping height without intervention of the operator to enable the operator to concentrate on guidance and control of depth of cut, with assurance that the elevator will protect itself upon striking of an obstruction by raising itself to a higher level and maintaining the higher level, especially desirable when encountering a continuous obstruction such as a windrow, while nevertheless providing the operator with full supervisory control.

In one of the aspects of the present invention means are provided responsive to the upraised, or transport, position of the bowl for insuring that the elevator is in the "free float" mode so that it may settle upon the slope of the soil in the bowl, or upon the limit stops, for maximum soil retention.

Other objects and advantages of the invention will become apparent upon reading the attached detailed description and upon reference to the drawings in which:

BRIEF DESCRIPTION OF THE DRAWINGS

FIG. 1 is a side elevation of a complete elevating scraper assembly, including tractor;

FIG. 2 is a fragmentary side view of the elevator of FIG. 1 showing the flights in desired sweeping clearance relationship with respect to the undisturbed ground, the cutter blade being adjusted to reference depth;

DETAILED DESCRIPTION OF PREFERRED EMBODIMENT

Figure 3:
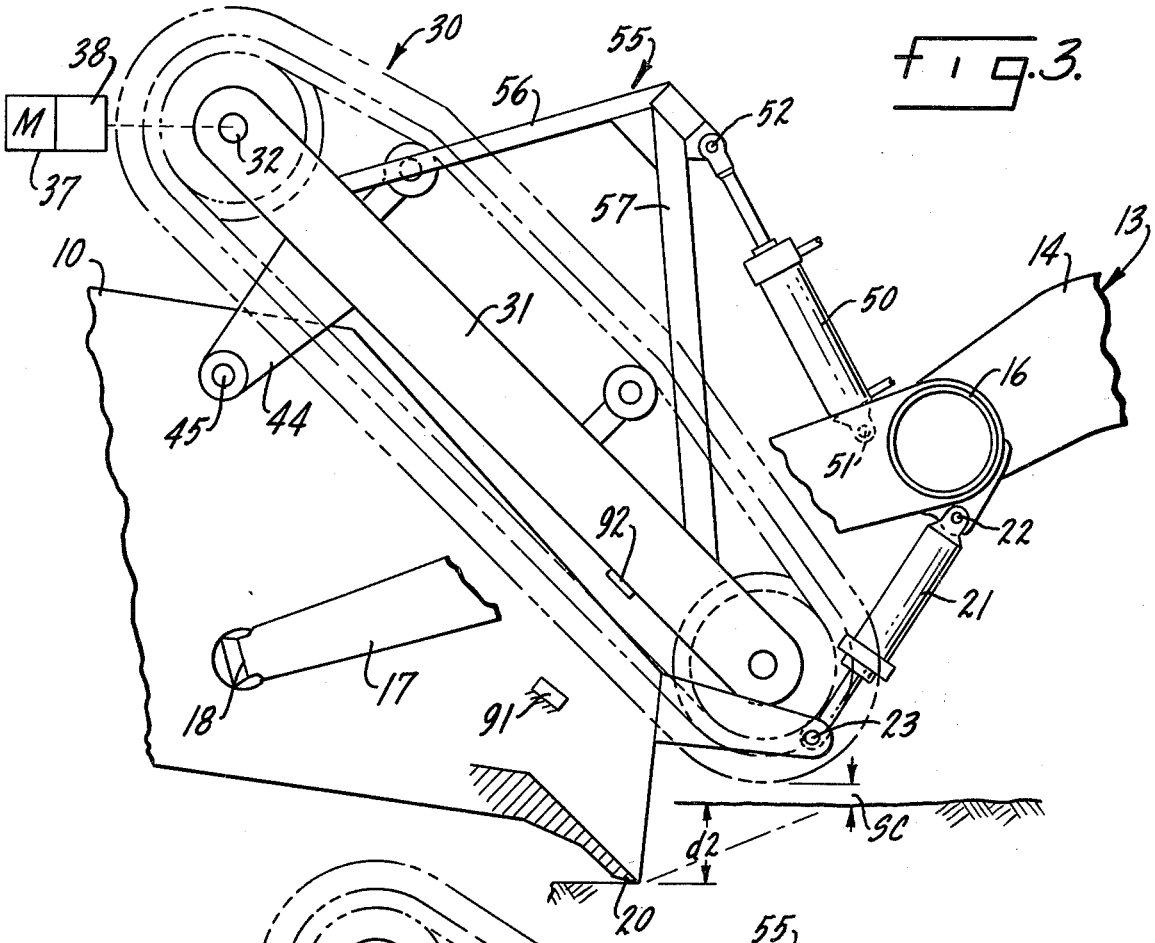
FIG. 3 is a view similar to FIG. 2 but showing the blade adjusted to take a deep cut, with automatic maintenance of the elevator at sweeping height.

Referring now to the drawings there is disclosed a scraper assembly made up of a bowl 10 having a supporting frame 11 and a tractor 12 having a draft frame 13. The draft frame includes a so-called gooseneck 14 which is of rigid construction pivoted to the tractor, at 15, for horizontal swinging movement and carrying a transversely extending torque tube 16 to which a pair of draft members 17 are secured. The latter extend rearwardly and downwardly and are provided at 18 to respective sides of the bowl. The frame of the bowl is supported upon a pair of rear wheels 19.

Mounted along the front edge of the bowl is a blade 20 which digs into the ground to a depth determined by the angle of tilt of the bowl about the draft axis 18. For determining this angle, and the cutting depth, a bowl supporting actuator 21 is provided at each side of the bowl, the actuator shown in FIG. 1 having an upper point of anchoring 22 to draft frame and a lower connection 23 to the front of the bowl.

For the purpose of conveying the soil loosened by the blade to the back of the bowl, an elevator 30 is provided (see especially FIG. 2) having a lower end which rides above and slightly ahead of the blade 20, the elevator extending rearwardly and upwardly and enclosing the front of the bowl. The elevator includes a pair of longitudinal frame members 31 journalling a cross shaft 32 driving a pair of sprocket wheels 33. At the bottom end of the elevator in aligned positions are idler wheels 34. Trained about the sprockets and idlers are conveyor chains 35 having transversely extending flights 36. The drive shaft 32 is driven by motor 37 through a gear box 38.

The blade 20 moving through the ground tends to break the soil clear along a shear plane indicated at 40. The elevator is mounted so that its low point, with respect to the undisturbed ground surface 41, approximately coincides with the end 42 of the shear plane. The elevator should be sufficiently elevated above the ground under running conditions as to provide a slight amount of sweeping or grazing clearance SC which may, for example, be on the order of an inch or so.

For the purpose of mounting the elevator for upward and forward swinging movement, thereby to change the position of the elevator with respect to the ground, and also for permitting the elevator to yield upon encountering windrows or other obstructions, the frame of the elevator is swingably supported upon a pair of arms 44 which are pivoted to the bowl structure along a transverse axis 45.

For the purpose of supporting the elevator at a predetermined height above the ground, and for controlling its movement, an elevator supporting actuator 50 is provided having a first end 51 connected to the tractor draft frame at a point adjacent the torque tube 16. The actuator 50, in accordance with the invention, extends rearwardly and upwardly from the tractor draft frame and has a second point of connection 52 which is coupled to the elevator frame. To achieve the desired orientation of the actuator 50 and to provide a point of connection which is both upwardly and forwardly of the elevator hinge axis 45, a bracket 55 is provided, the bracket preferably being of triangular shape having legs 56 and 57 anchored to the elevator frame member by welding or the like, at points 58, 59. The actuator 50 is double ended and means are provided, as will be discussed, for locking hydraulic fluid in the actuator causing the spacing between the ends 51, 52 thereof to be rigidly fixed under normal running conditions, resulting in automatic adjustment of elevator height in spite of variations in the depth of the cutter blade 20, without resort to a servo system. In the condition illustrated in FIG. 2 the cutter blade is at a reference or average depth d1.

When it is desired to increase the depth of cut, the operator, with remote control, admits fluid to the bowl supporting actuators 21 causing the bowl 10 to rock downwardly about the rear axle so that the blade 20 takes a deeper cut *d2* as illustrated in FIG. 3. Since the elevator height, above ground, is not directly a function of the level of the bowl in the absence of the usual supporting stops, and since the elevator is rigidly coupled to the draft frame by means of the fluid locked in the bowl supporting actuator 50, the elevator does not follow the blade down to a lower level.

However, in tilting the bowl downwardly the elevator hinge axis 45 drops slightly, tending to lower the level of the elevator by a small amount. The hinge axis 18 also drops slightly, which lowers the arms 17 of the draft frame and hence the torque tube 16 which supports the actuator 50. Both of these effects might be expected to cause limited downward movement at the front end of the elevator as cutting depth is increased. However, because of the upwardly and rearwardly extending position of the actuator 50, which is in hydraulically blocked condition, and because of the position of the bracket 55 to which it is connected, the lower end of the elevator does not move downwardly but, on the contrary, remains at a constant clearance height, SC. The reason for this is that downard rocking of the bowl, accompanied by dropping of the pivot axis 18 causes the tractor draft frame, including members 17, to relatively scissor about axis 18 in a direction toward the bowl. The scissoring causes the actuator 50 to crowd rearwardly against the bracket 55 secured to the upper portions of elevator frame, tending to hold the elevator frame at its initial level. In short the system is self-compensating for the sinking movement of the draft frame.

Figure 4:
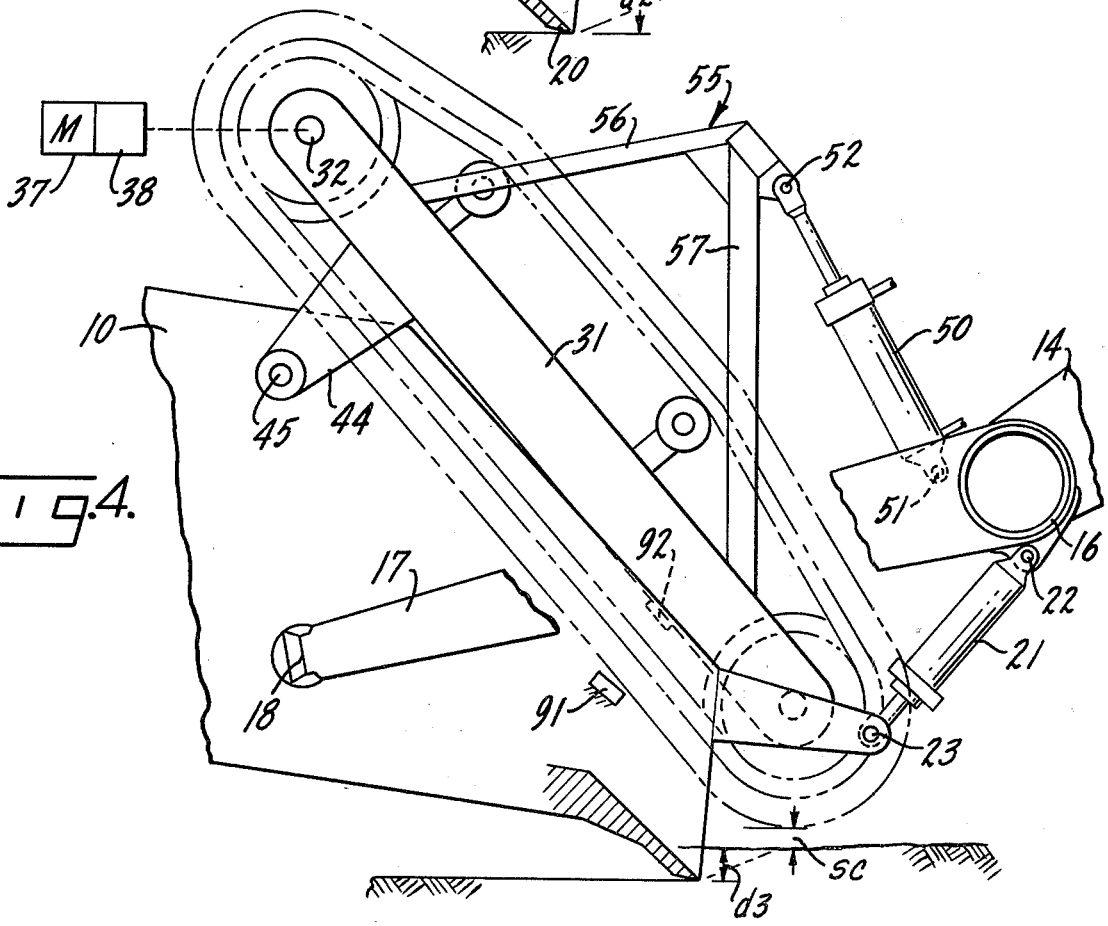
FIG. 4 is a view similar to FIG. 2 but with the blade adjusted to take a shallow cut, again with maintenance of sweeping height.

The converse movement occurs as a shallower cut is taken as illustrated in FIG. 4. In this figure it will be assumed that the operator, using the normal controls, has contracted the bowl hoist actuator 21, causing the front end of the bowl to be slightly elevated so as to take a shallower cut *d*3. The raising of the elevator hinge axis 45, and the axis 18 of the tractor draft frame as the bowl is raised might be expected to result in raising of the elevator. However, because of the reverse scissoring action of the draft members 17 about axis 18 which accompanies the elevation of the front of the bowl, the draft frame, and particularly the point of connection of the actuator 50, tends to move relatively forwardly, away from the bowl. The effect is to prevent the front end of the elevator from being raised so that it maintains the same sweeping height SC. Stated in general terms, the sweeping or clearance, height tends to remain substantially constant for all depths of cut within the operating range of the bowl. Thus the operator of the machine can concentrate upon adjusting the depth of cut without having to make a corresponding change each time, in elevator height.

Figure 5:
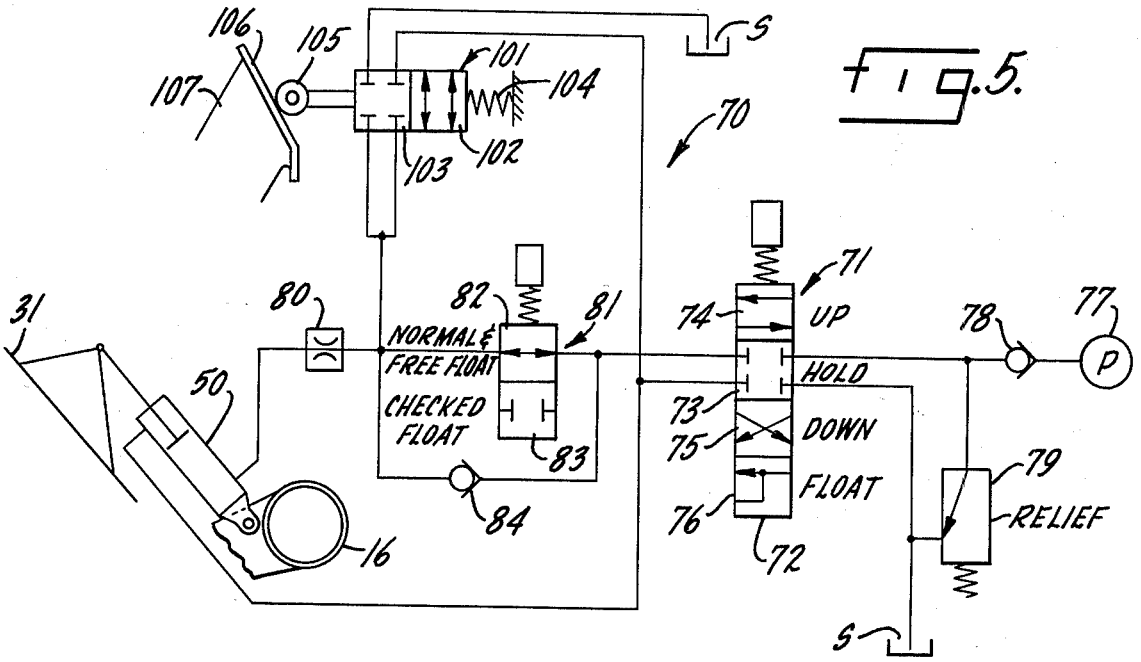
FIG. 5 is a schematic diagram of a hydraulic circuit providing selectable modes of operation, FIG. 5*a* being an alternative.

In accordance with the invention, provision is made for setting of the maintained sweeping height by the operator, utilizing a hydraulic circuit of the type set forth at 70 in FIG. 5. Such circuit includes a control valve 71 having a plunger 72 with a central "hold" position 73 and alternative "up" and "down" positions 74, 75 and a "float" position 76. The control valve 71 is supplied with pressurized fluid from a pump 77 through a check valve 78. A relief valve 79 at the outlet of the check valve serves to divert excess fluid to a sump S when the pressure exceeds a predetermined level.

It will be noted that with the control valve 71 in the "hold" position, illustrated in FIG. 5, a loop circuit is formed with the ends of the actuator 50, but the flow of fluid in the loop is blocked so that the actuator is in the normally rigidified condition as discussed.

However, when it is desired to increase the sweeping height SC, the valve plunger 72 is normally moved to the "up" position in which pressurized fluid is admitted to the right-hand end of the actuator, with withdrawal of fluid at the left-hand end, to expand the actuator, thereby to swing the elevator frame slightly in a counterclockwise direction about the axis 45, following which the valve plunger is restored to its "hold" position. The sweeping height is thereafter automatically maintained at the new level. Conversely, by moving the valve plunger 72 to the "down" position, the actuator 50 is contracted to rock the elevator frame clockwise, that is, downwardly, to reduce the sweeping height, the valve 71 being restored to the "hold" position, with automatic maintenance thereafter.

Such remote manual control is not only useful in maintaining the sweeping height, under difficult conditions, at a "rock clearance" level but also for raising the elevator briefly to accommodate a boulder or similar casual obstruction.

In carrying out the present invention, the control valve 71 has a fourth position 76 in the form of a bypass so that the hydraulic loop which includes the actuator 50 is freely short-circuited to enable flow of fluid from one end of the actuator 50 to the other with the result that the elevator is free to "float" upwardly and downwardly as it encounters, and passes, obstructions. Thus when the boulder or the like is encountered, the elevator flights will tend to "climb up" upon the boulder raising the elevator frame which subsequently descends to its initial position when the obstruction has been traversed. To prevent bouncing of the elevator frame under such conditions, a damping orifice 80, in the form of a narrowing restriction, is included in the loop to damp, that is, inhibit, the expanding and contracting movements of the actuator.

Further in accordance with the invention a selector valve 81 is included in the loop circuit having a first position 82 which provides a "through" connection and a second position 83 in which the flow is blocked. The selector valve is bypassed by a check valve 84 so that when the selector valve is in its blocking position fluid may still flow around the loop in a direction corresponding to elongation of the actuator 50, that is, in a direction which will accommodate the raising of the elevator which occurs when the elevator "climbs up" upon an obstruction. However, because of the checking, or blockage, of fluid flow in the opposite direction, the actuator 50 is not free to contract so that it holds the elevator in upraised condition, at the maximum level which it has achieved. Such condition is conveniently referred to as "checked float"; that is, the elevator is free to float or climb upwardly upon obstruction, but any subsequent downward movement is prevented or checked until the operator intervenes.

Such "checked float" mode is highly advantageous when encountering a windrow which extends along the direction of movement of the scraper. Without the checking action, the elevator flights would continue to beat against the windrow along its entire length resulting in repeated shocks to the machine and with possibility of physical damage. Under the "checked float" mode, the elevator, having once climbed upon the windrow, is automatically supported at the higher elevation, thereby protecting the flights against subsequent impact. Once the windrow has been traversed, the operator can, by movement of the control valve 81 to the "normal" position, lower the elevator back to a normal sweeping height for automatic holding in the normal position.

It is one of the features of the present control system that after the elevator has been positioned at a desired clearance height, and is being "held" at that position the system may be switched to the "checked float" mode, to take advantage of the self-protecting features, while preserving the elevation height adjustment, as follows: After the elevator is at the desired height and the control valve is in the "hold" position, the selector valve is switched to its "checked float" position. With the elevator in its "checked float" condition the actuator 50 is positively blocked against contraction and thus elevator height will be maintained as described, though the operator may make radical changes in cutting depth.

Figure 5A:
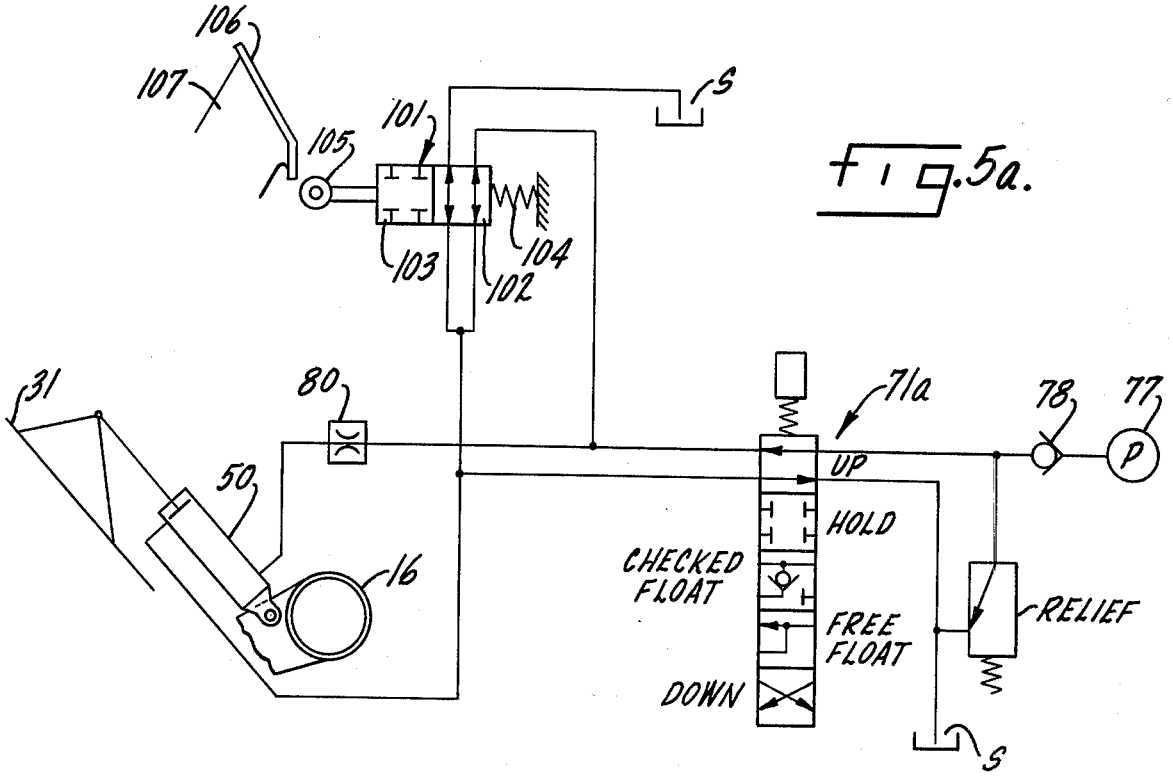

To simplify the operation of the valves, the "float" position 76 and the "down" position 75 of the valve plunger may be interchanged to make it possible to go directly from "hold" to the "checked float" condition without traversing the "down" setting. Carrying simplification a step further, the functions of the control and selector valves may be combined as shown in FIG. 5*a* in which the operator need only operate a single valve 71*a* for adjustment of running level and for mode switching.

Although it is one of the features of the present invention that no "fixed but adjustable" stops are necessary to establish the running height of the elevator, it is nevertheless desirable to have a pair of bottoming stops to limit the proximity between the elevator and the bowl to keep the elevator flight envelope safely clear of the blade 20, especially during the transport condition illustrated in FIG. 1. Such buttoming stops may include a first stop 91 on the bowl and a second, cooperating, stop 92 on the elevator frame (see especially FIG. 2).

Figure 6:
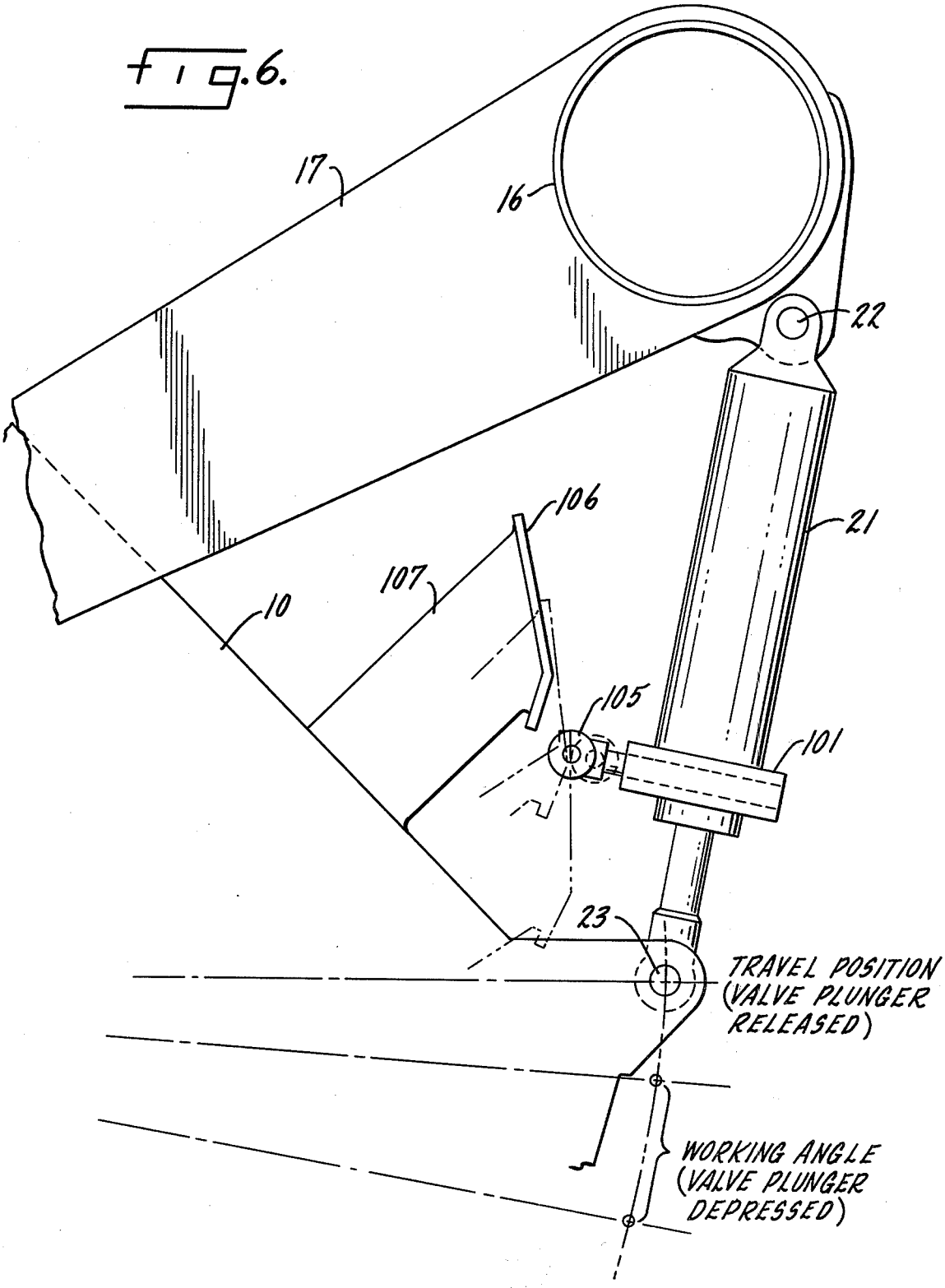
FIG. 6 is a fragmentary diagram showing modification of the control function in accordance with bowl position.

In accordance with one of the aspects of the invention, the position of bowl relative to the draft frame may be used to control the mode of the hydraulic control circuit, permitting operation in the "checked float" mode during the loading operation but insuring a "free float" condition during transport. This is accomplished by providing an auxiliary "free float " - "check float" valve 101 connected in parallel with the actuator 50 and having plunger sections 102, 103, the plunger having a return spring 104. The valve 101 is mounted fixedly with respect to the draft frame; preferably it is secured to the body of the bowl hoise actuator 21 as shown in FIG. 6. Interlock means in the form of a cam and cam follower are provided for controlling the valve position.

Thus the valve 101 has a cam follower 105 which engages a cam 106 mounted upon a bracket 107 secured to the bowl. The cam 106 is so shaped that when the bowl is tilted downwardly within its working range the cam follower 105 presses the valve plunger inwardly against return spring 104 permitting operation in all of the modes discussed above. However, when the bowl hoist cylinder 21 is contracted to raise the front of the bowl for transport, the cam 106 relatively retreats, causing the cam follower 105 to move outwardly and the section 102 of the auxiliary valve to move into active position thereby providing by-pass around the actuator so that the elevator is free floating. The auxiliary valve thus insures that the elevator, during transport, is in its maximum retentive position in which the elevator either rests against the slope of the contained soil or bottoms against the protective limit stops. With valve 101 in the system, valve 71 (or 71*a*) should preferably be restored to the "hold" position after the bowl is raised to avoid continual flow of fluid back to the reservoir.

It will be apparent that the objects of the invention are amply carried out by the disclosed mechanism. Under normal running conditions, with the fluid locked in the actuator 50, the actuator nonetheless, by maintaining a constant spacing upwardly and rearwardly, from draft frame to elevator frame, serves to automatically maintain a substantially constant sweeping height regardless of the depth to which the blade 20 may be adjusted. Once the sweeping height is set, the operator need give it no further thought. This is to be contrasted with the nuisance of adjusting the "working" stops provided in the usual elevating scraper. Moreover, the usual "working" stops compromise load retention since they hold the elevator at an artificially high position during transport so that leakage may occur. In the present construction, by way of contrast, the valve 101 responsive to bowl position, insures that the elevator is fully retentive whenever the bowl is upraised. Even during normal operation retention is favorable since the elevator operates constantly at its lowest position consistent with maintenance of ground clearance.

Since elevator height is automatically maintained, there is no longer any need to compromise efficiency with risk of elevator self-destruction, and relatively widely spaced flights may be used, operated at high speed, with elevating efficiency the only consideration. By designing the elevator for greatest elevating efficiency and maximum retention, it is possible to handle a broad range of soil and to make use of the maximum earth-moving capability of the bowl.

The hydraulic loop circuit makes it possible to use simple hydraulic damping means, and thus there is no need to employ auxiliary energy absorbing stops to cushion movement at the ends of the stroke, the amount of the damping being readily adjustable by adjusting the orifice size.

Not only does the system permit automatic maintenance of elevator height with manual setting and manual override, but the alternate modes of operation, particularly the "free float" and "check float" modes are obtainable with minimum complication and at minor expense.

I claim as my invention:

1. In an elevating type scraper for earth moving purposes, the combination comprising an open-fronted bowl having sides, back wall and a floor, ground wheels for supporting the bowl and mounted behind the back wall, a scraper blade extending along the front edge of the floor, a tractor-supported draft frame, a pair of draft members pivotally secured at the rear ends to the sides of the bowl and extending forwardly and upwardly having rigid connection at their front ends to the draft frame, means including a bowl hoist actuator interposed between the draft frame and the front end of the bowl and having control means for determining the degree of tilt of the bowl about its supporting wheels and hence the depth of cut of the blade, an elevator positioned at the open front end of the bowl, the elevator having a frame which extends upwardly and rearwardly from the region of the blade and which is mounted to the bowl for swinging movement in the longitudinal plane, the elevator having a pair of endless chains with transversely arranged flights, the chains having means for driving at one end of the frame and trained about rollers at the other end so that the flights sweep the soil loosened by the blade backwardly into the bowl, means including an elevator supporting actuator interposed between the draft frame and the elevator frame for supporting the elevator relative to the ground, and control valve means having a source of pressurized fluid for controlling the flow of fluid to the elevator supporting actuator and for locking fluid in such actuator so that the elevator is supported at a desired sweeping height above the undisturbed ground, the control valve means having means permitting free flow of fluid into and out of the elevator supporting actuator to establish a "free float" condition so that the elevator can rise and fall to accommodate obstructions on the ground, the control valve means further having an associated check valve interposed in the path of fluid flow for establishing a "checked float" condition in which the check valve yields to enable the elevator to climb upon an encountered obstruction thereby lifting itself to a higher level but with the check valve thereafter closing to block flow of fluid in the reverse direction so that the elevator is temporarily maintained at the higher level, and means for subsequently releasing the blocked fluid to restore the elevator to a normal working level.

2. In an elevating type scraper for earth moving purposes, the combustion comprising an open-fronted bowl having sides, back wall and a floor, ground wheels for supporting the bowl and mounted behind the back wall, a scraper blade extending along the front edge of the floor, a tractor-supported draft frame, a pair of draft members pivotally secured at the rear ends to the sides of the bowl and extending forwardly and upwardly having rigid connection at their front ends to the draft frame, means including a bowl hoist actuator interposed between the draft frame and the front end of the bowl and having control means for determining the degree of tilt of the bowl about its supporting wheels and hence the depth of cut of the blade, an elevator positioned at the open front end of the bowl, the elevator having a frame which extends upwardly and rearwardly from the region of the blade and which is mounted to the bowl for swinging movement in the longitudinal plane, the elevator having a pair of endless chains with transversely arranged flights, the chains having means for driving at one end of the frame and trained about rollers at the other end so that the flights sweep the soil loosened by the blade backwardly into the bowl, means including an elevator supporting actuator interposed between the draft frame and the elevator frame for supporting the elevator relative to the ground, and control valve means having a source of pressurized fluid for controlling the flow of fluid to the elevator supporting actuator and for locking fluid in such actuator so that the elevator is supported at a desired sweeping height above the undisturbed ground, the elevator positioning actuator being of double-ended construction and the control valve means including a by-pass for creating a closed loop of conduit between the ends of the actuator for establishing a "free float" condition in which the elevator is free to rise to a higher level by climbing upon the encountered obstruction and to fall to a normal level when the obstruction is passed, the control valve means further including a check valve with means for selectively interposing the check valve in the loop in such a direction as to establish an alternative "checked float" condition in which the check valve yields to permit flow of fluid through the loop in the rising direction but in which the check valve seals to block the flow of fluid through the loop in the falling direction so that the elevator is temporarily maintained at the higher level, the control valve means still further including means for subsequently releasing the blocked fluid to restore the elevator to a normal working level.

3. The combination as claimed in claim 2 in which the loop includes a restricted orifice for damping the movements of the second actuator in both the "free float" and "checked float" conditions.

4. In an elevating type scraper for earth moving purposes, the combination comprising an open-fronted bowl having sides, back wall and a floor, ground wheels for supporting the bowl and mounted behind the back wall, a scraper blade extending along the front edge of the floor, a tractor-supported draft frame, a pair of draft members pivotally secured at the rear ends to the sides of the bowl and extending forwardly and upwardly having rigid connection at their front ends to the draft frame, means including a bowl hoist actuator interposed between the draft frame and the front end of the bowl and having control means for determining the degree of tilt of the bowl about its supporting wheels and hence the depth of cut of the blade, an elevator positioned at the open front end of the bowl, the elevator having a frame which extends upwardly and rearwardly from the region of the blade and which is mounted to the bowl for swinging movement in the longitudinal plane, the elevator having a pair of endless chains with transversely arranged flights, the chains having means for driving at one end of the frame and trained about rollers at the other end so that the flights sweep the soil loosened by the blade backwardly into the bowl, means including an elevator supporting actuator interposed between the draft frame and the elevator frame for supporting the elevator relative to the ground, and control valve means having a source of pressurized fluid for controlling the flow of fluid to the elevator supporting actuator and for locking fluid in such actuator so that the elevator is supported at a desired sweeping height above the undisturbed ground, the elevator supporting actuator being double-ended, means defining a loop of conduit, the control valve means having provision (1) for causing pressurized fluid to flow through the loop in opposite directions for respectively raising and lowering the elevator, (2) for causing fluid to be blocked in the loop in both directions thereby to hold the elevator at a selected level with respect to the ground, (3) for causing the fluid to be blocked in the loop in one direction only thereby to establish a "checked float" condition in which the elevator can climb up upon an obstruction with automatic holding at the higher level, and (4) for causing the loop to be unobstructed thereby to establish a "free float" condition in which the elevator is free to rise and fall as obstructions are encountered and passed, and a restriction in the loop for damping the flow of fluid therein.

5. In an elevating type scraper for earth moving purposes, the combination comprising an open-fronted bowl having sides, back wall and a floor, ground wheels for supporting the bowl and mounted behind the back wall, a scraper blade extending along the front edge of the floor, a tractor-supported draft frame, a pair of draft members pivotally secured at the rear ends to the sides of the bowl and extending forwardly and upwardly having rigid connection at their front ends to the draft frame, means including a bowl hoist actuator interposed between the draft frame and the front end of the bowl and having control means for determining the degree of tilt of the bowl about its supporting wheels and hence the depth of cut of the blade, an elevator positioned at the open front end of the bowl, the elevator having a frame which extends upwardly and rearwardly from the region of the blade and which is mounted to the bowl for swinging movement in the longitudinal plane, the elevator having a pair of endless chains with transversely arranged flights, the chains having means for driving at one end of the frame and trained about rollers at the other end so that the flights sweep the soil loosened by the blade backwardly into the bowl, means including an elevator supporting actuator interposed between the draft frame and the elevator frame for supporting the elevator relative to the ground, and control valve means having a source of pressurized fluid for controlling the flow of fluid to the elevator supporting actuator and for locking fluid in such actuator so that the elevator is supported at a desired sweeping height above the undisturbed ground, a bracket rigidly secured to the front edge of the elevator frame providing a point of connection upwardly and forwardly of the transverse pivot axis of the elevator frame, the elevator supporting actuator being oriented to occupy a constantly angled position in which it extends upwardly and rearwardly from a point of connection on the tractor draft frame to the point of connection on the bracket so that when fluid is locked in the elevator supporting actuator the elevator is automatically maintained at substantially the desired sweeping height above the undisturbed ground in spite of changes in the degree of tilt of the bowl and depth of cut of the blade.

6. The combination as claimed in claim 5 in which the control valve means includes means for alternative adding of fluid to the respective ends of the elevator supporting actuator to vary the locked position of the actuator thereby to vary maintained elevator height.

7. In an elevating type scraper for earth moving purposes, the combination comprising an open-fronted bowl having sides, back wall and a floor, ground wheels for supporting the bowl and mounted behind the back wall, a scraper blade extending along the front edge of the floor, a tractor-supported draft frame, a pair of draft members pivotally secured at the rear ends to the sides of the bowl and extending forwardly and upwardly having rigid connection at their front ends to the draft frame, means including a bowl hoist actuator interposed between the draft frame and the front end of the bowl and having control means for determining the degree of tilt of the bowl about its supporting wheels and hence the depth of cut of the blade, an elevator positioned at the open front end of the bowl, the elevator having a frame which extends upwardly and rearwardly from the region of the blade and which is mounted to the bowl for swinging movement in the longitudinal plane, the elevator having a pair of endless chains with transversely arranged flights, the chains having means for driving at one end of the frame and trained about rollers at the other end so that the flights sweep the soil loosened by the blade backwardly into the bowl, means including an elevator supporting actuator interposed between the draft frame and the elevator frame for supporting the elevator relative to the ground, the control valve means having a source of pressurized fluid for controlling the flow of fluid to the elevator supporting actuator and for locking fluid in such actuator so that the elevator is supported at a desired sweeping height above the undisturbed ground, an auxiliary valve being provided responsive to raising of the bowl to transport position clear of the ground (a) for establishing an hydraulic connection between the ends of the elevator supporting actuator to ensure that the elevator is free to settle against the soil in the bowl during transport to retain the soil and (b) for blocking such connection when the bowl is subsequently lowered to loading position.

8. In an elevating type scraper for earth moving purposes, the combination comprising an open-fronted bowl having sides, back wall and a floor, ground wheels for supporting the bowl and mounted behing the back wall, a scraper blade extending along the front edge of the floor, a tractor-supported draft frame, a pair of draft members pivotally secured at the rear ends to the sides of the bowl and extending forwardly and upwardly having rigid connection at their front ends to the draft frame, means including a bowl hoist actuator interposed between the draft frame and the front end of the bowl and having control means for determining the degree of tilt of the bowl about its supporting wheels and hence the depth of cut of the blade, an elevator positioned at the open front end of the bowl, the elevator having a frame which extends upwardly and rearwardly from the region of the blade and which is mounted to the bowl for swinging movement in the longitudinal plane, the elevator having a pair of endless chains with transversely arranged flights, the chains having means for driving at one end of the frame and trained about rollers at the other end so that the flights sweep the soil loosened by the blade backwardly into the bowl, means including an elevator supporting actuator interposed between the draft frame and the elevator frame for supporting the elevator relative to the ground, and control valve means having a source of pressurized fluid for controlling the flow of fluid to the elevator supporting actuator and for locking fluid in such actuator so that the elevator is supported at a desired sweeping height above the undisturbed ground, the combination further including an auxiliary valve connected across the elevator supporting actuator having a bypass position and a blocking position, interlock means interposed between draft frame and the bowl responsive to raising the bowl to transport position for moving the valve to its bypass position so that the elevator is during transport unsupported by the actuator, and limit stops interposed between the elevator and the bowl for keeping the elevator safely clear of the blade.

9. The combination as claimed in claim 8 in which the auxiliary valve is fixedly mounted with respect to the draft frame and in which the interlock means is in the form of a cam surface on the bowl cooperating with a cam follower on the valve.

* * * * *